United States Patent [19]

Miller, Jr.

[11] Patent Number: 4,896,160

[45] Date of Patent: Jan. 23, 1990

[54] AIRBORNE SURVEILLANCE PLATFORM

[75] Inventor: William M. Miller, Jr., Princeton, N.J.

[73] Assignee: Aereon Corporation, Princeton, N.J.

[21] Appl. No.: 157,694

[22] Filed: Feb. 19, 1988

[51] Int. Cl.[4] ..... H01Q 3/22; H01Q 1/28

[52] U.S. Cl. ..... 342/368; 343/708

[58] Field of Search ..... 342/368; 343/708

[56] References Cited

U.S. PATENT DOCUMENTS

| | | | |
|---|---|---|---|
| Re. 28,454 | 6/1975 | Fitzpatrick et al. | 244/25 |
| 3,684,217 | 8/1972 | Kukon et al. | 244/36 |
| 3,761,041 | 9/1973 | Putman | 244/13 |
| 4,149,688 | 4/1979 | Miller, Jr. | 244/12.4 |
| 4,662,588 | 5/1987 | Henderson | 343/708 |

OTHER PUBLICATIONS

Defense News, Aug. 15, 1988, pp. 1,30.

*Primary Examiner*—Thomas H. Tarcza
*Assistant Examiner*—David Cain
*Attorney, Agent, or Firm*—Howson and Howson

[57] ABSTRACT

An airborne surveillance platform utilizes a low aspect ratio delta-shaped aircraft having a radar-transparent hull. The antenna is located within, and stationary relative to, the hull. The antenna comprises planar or linear phased arrays arranged to scan in a continuous pattern in all azimuthal directions. Planar phased arrays can be arranged to scan in a continuous pattern in the range from zenith to nadir or in portions of that range.

11 Claims, 5 Drawing Sheets

FIG 5
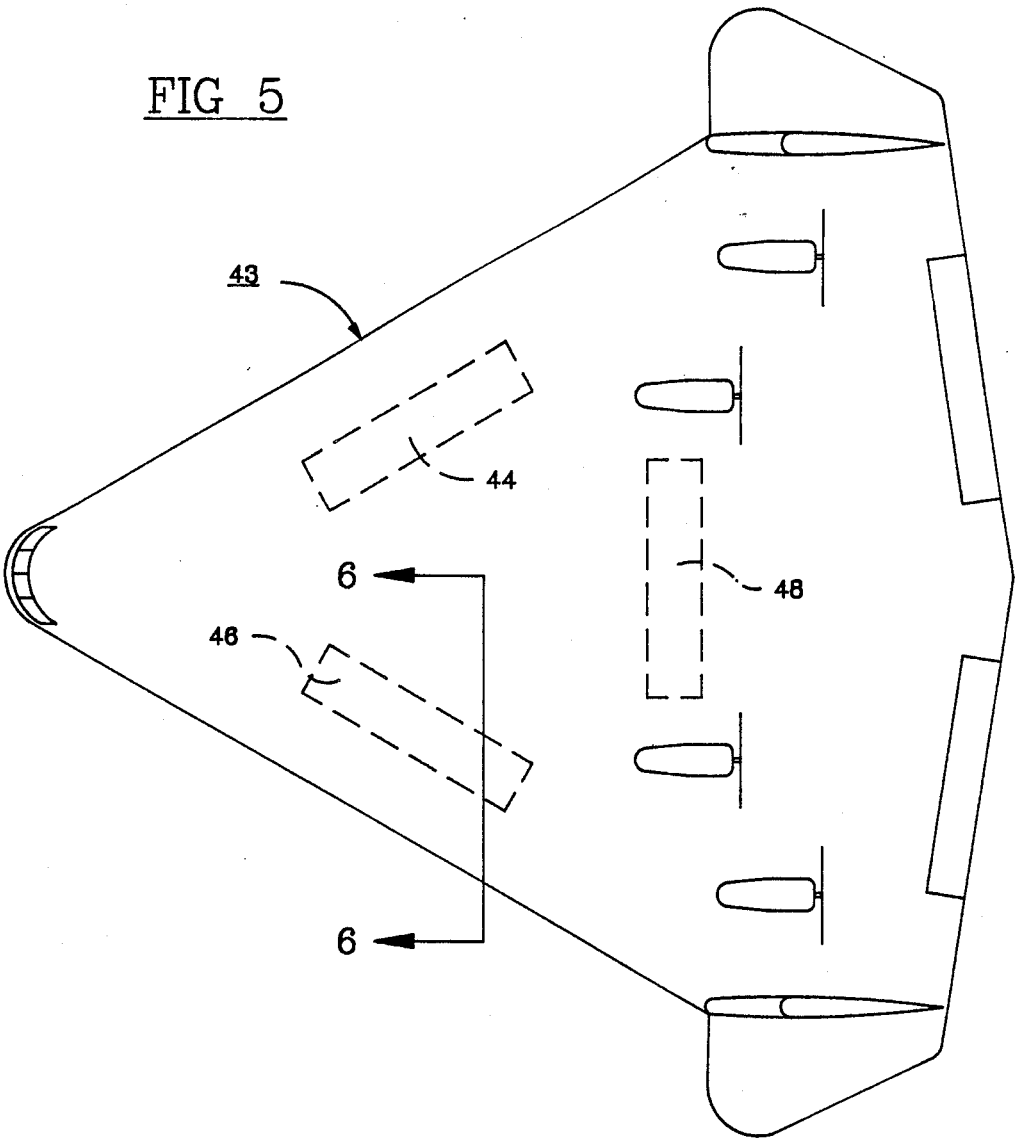
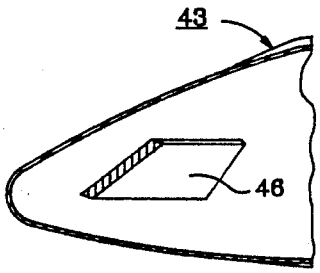
FIG 6
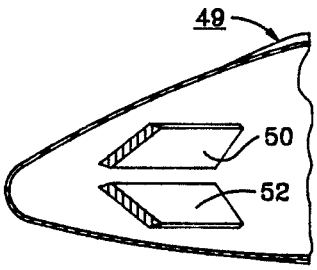
FIG 7

AIRBORNE SURVEILLANCE PLATFORM

BRIEF SUMMARY OF THE INVENTION

This invention relates to surveillance by the detection of reflected radar signals or other radio signals emanating from a target. More specifically, the invention relates to an airborne surveillance antenna platform. An airborne surveillance antenna platform has particular utility in the detection and tracking of ballistic missiles and cruise missiles.

Airborne surveillance by radio signal detection has been carried out by means of mechanically steerable antennas. Such antennas are necessarily limited in size. Larger mechanically steerable antennas, when carried by an aircraft, are necessarily mounted externally, and create flight performance problems.

Modern phased array technology has been used to create surveillance antennas which are electronically steerable both in azimuth and elevation, with directional patterns equivalent to, or better than, those of a mechanically steerable antenna.

For missile detection and tracking, it is generally necessary to scan in all azimuthal directions. A practical phased array capable of scanning in all azimuthal directions, if carried by an aircraft of conventional size and shape, would necessarily be mounted on the exterior. It would be possible to mount a phased array within the interior of a gas-filled airship, if appropriate measures were taken to prevent the airship structure from interfering with antenna performance. However, an airship has both altitude and speed limitations, which seriously constrain its use as a surveillance platform.

The principal object of the present invention is to provide an airborne surveillance platform which meets the requirements of long endurance and high altitude flight capability, and which is capable of scanning in all azimuthal directions with a phased antenna array.

A further object of the invention is to provide for scanning in all azimuthal directions and also in a range of elevations, which may include the entire range from zenith to nadir, or a portion or portions of that range.

Still a further object of the invention is to provide an airborne surveillance platform capable of unmanned flight under remote control.

In accordance with the invention, use is made of a low aspect ratio triangular aircraft hull configuration of the kind described in U.S. Pat. No. Re. 28,454, dated June 17, 1975, and in U.S. Pat. Nos. 3,684,217, dated Aug. 15, 1972, 3,761,041, dated Sept. 25, 1973 and 4,149,688 dated Apr. 17, 1979. The disclosures of these patents are here incorporated by reference. Briefly, the hull configuration is characterized by a delta-shaped planform with a narrow nose at one corner, leading edges extending from the nose to the opposite corners, and a trailing edge extending between said opposite corners, the planform being substantially symmetrical about a plane of symmetry extending from said narrow nose to the midpoint of the trailing edge, ellipse-like cross-sections tranverse to said plane throughout substantially all of the length of the hull, a maximum height dimension in said plane perpendicular to the chord in said plane at a location spaced from said trailing edge and from said nose, said ellipse-like cross-sections progressively decreasing in height, measured in said plane, throughout substantially the entire distance from the cross-section at the point of maximum height toward said trailing edge.

The aircraft structure in accordance with the invention utilizes composite materials to provide a radar-transparent hull. Within the hull, a phased array antenna is provided. The delta-shaped planform of the hull lends itself to optimum use of space by a triangular antenna comprising three arrays, one being arranged to scan through one of the leading edges, another being arranged to scan through the other leading edge, and a third being arranged to scan through the trailing edge. The triangular configuration of three arrays makes it possible to scan through 360 degrees in azimuthal directions by electronic steering. The deltoid platform for the triangular antenna inherently maximizes radar size for a given platform size, with a resultant enhancement of operability, maintainability and ground-basing of the system. The deltoid platform design also has the advantage of allowing cockpit, engines and fins to be out of the main path of microwave energy radiated from the antenna arrays.

Depending on the frequency ranges desired, different kinds of antenna arrays can be used. At high frequencies, planar arrays offer the advantage of electrical steerability in both azimuth and elevation. Advantages of the invention can also be realized with linear phased arrays, one in each leading edge and one in the trailing edge. Linear phased arrays so arranged are electrically steerable in azimuth only, but can operate at the longer radar wavelengths at which target resonance comes into play.

In one embodiment of the invention utilizing planar phased arrays, each of three planar antenna arrays is inclined at an angle of approximately 45 degrees relative to the horizon, so that scanning can take place not only in all azimuthal directions, but also from the zenith to below the horizon. Where it is desired to scan from the zenith to locations directly, or nearly directly below the surveillance platform, six planar arrays may be used, consisting of three upper arrays capable of scanning from the zenith to the horizon, and three lower arrays capable of scanning from the horizon to the nadir. Alternatively, zenith to nadir scanning can be achieved using four planar phased arrays, three being inclined at 60 degrees relative to the horizon (30 degrees declination) and the remaining array being horizontal and directed upwardly.

In the case of linear phased arrays, three arrays are used, two extending along the interiors of the respective leading edges of the aircraft, and the other extending along the trailing edge.

Further objects and advantages of the invention will be apparent from the following detailed description, when read in conjunction with the drawings.

BRIEF DESCRIPTION OF THE DRAWINGS

FIG. 5 is a top plan view showing an alternative configuration of planar phased arrays in an airborne surveillance platform in accordance with the invention;

FIG. 6 is a diagrammatic sectional view taken on the plane 6—6 of FIG. 5;

FIG. 7 is a diagrammatic sectional view, similar to FIGS. 4 and 6, showing a further alternative antenna configuration;

DETAILED DESCRIPTION

Figure 1:
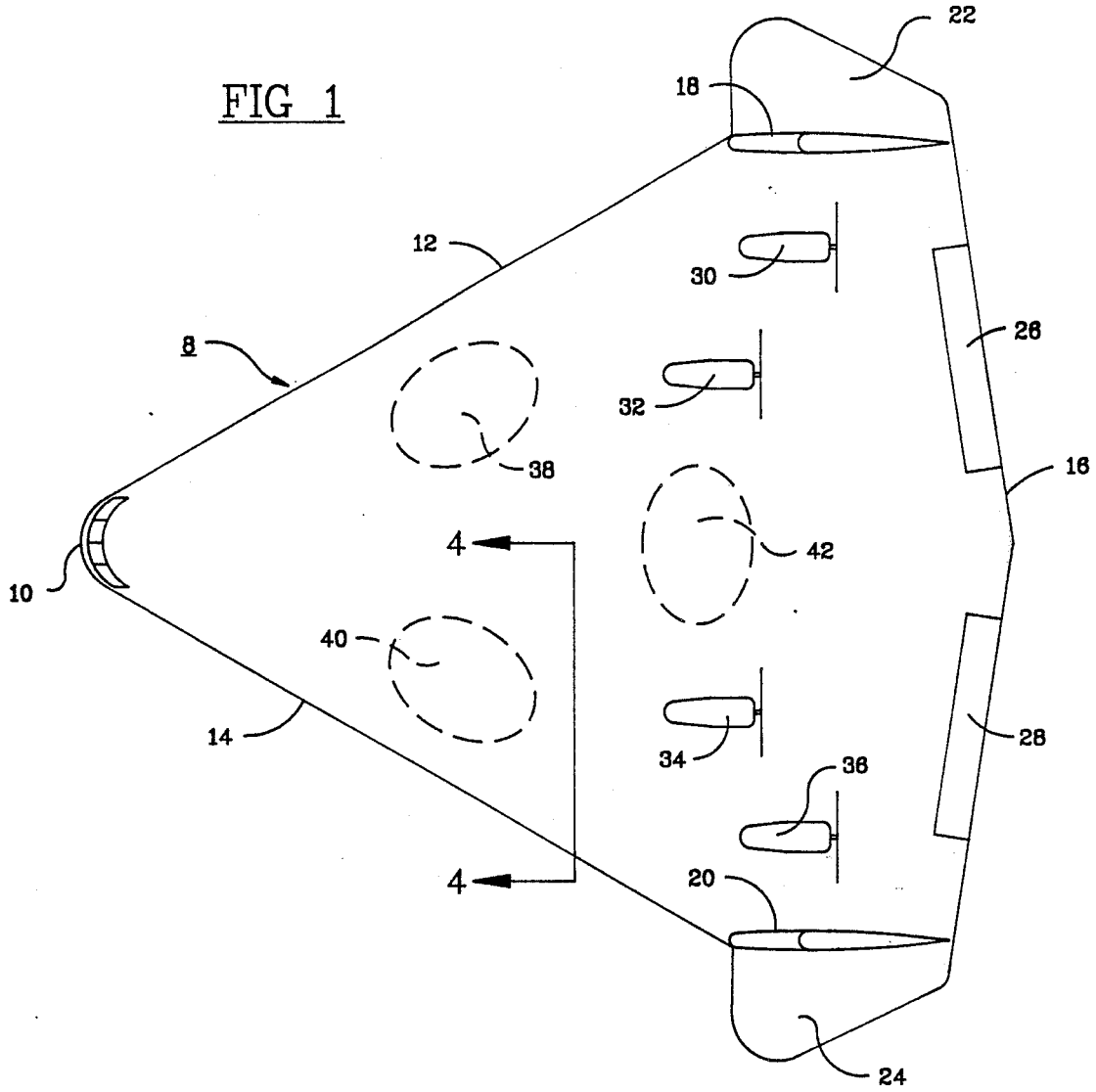
FIG. 1 is a top plan view illustrating one configuration of planar phased arrays in an airborne surveillance platform in accordance with the invention.
Figure 2:
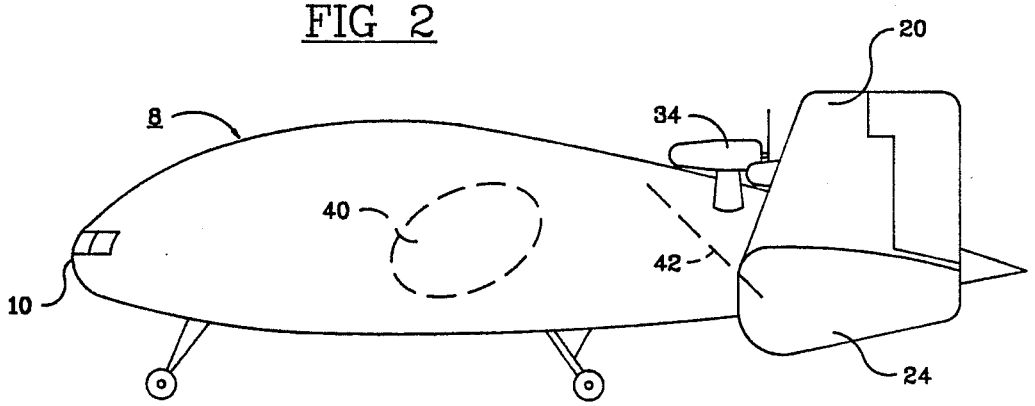
FIG. 2 is a side elevation of the airborne surveillance platform of FIG. 1.
Figure 3:
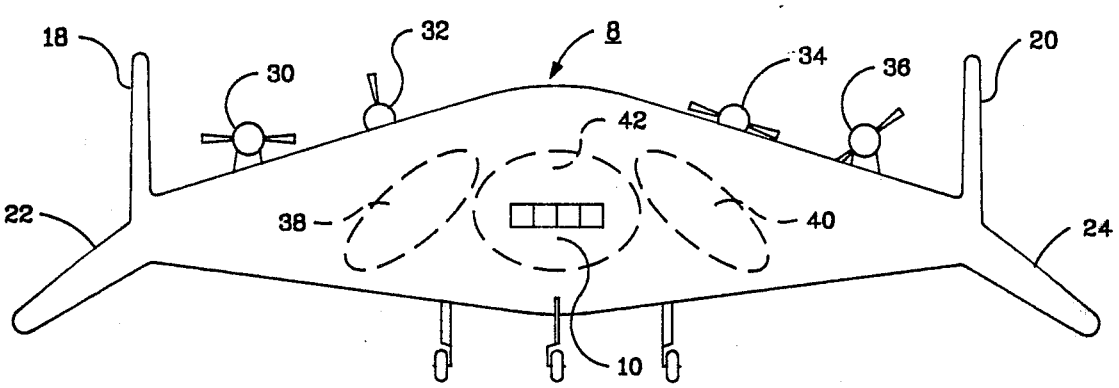
FIG. 3 is a front elevation of the airborne surveillance platform of FIG. 1.

As shown in FIGS. 1, 2 and 3, the airborne surveillance platform comprises a low aspect ratio aircraft hull 8 having a delta-shaped planform with a narrow nose 10. Leading edges 12 and 14 extend from the corner at which nose 10 is located to the opposite corners, between which there extends the trailing edge 16. Vertical stabilizers 18 and 20 are provided at the opposite ends of the trailing edge. Drooping airfoil surfaces 22 and 24 are also provided at the trailing edge, in accordance with U.S. Pat. No. 3,684,217, to compensate for excessive rolling moment due to the sideslip which results from the high sweep angle of the leading edges. Control surfaces are provided along the trailing edge at 26 and 28. On the upper surface of the body, propulsion units are provided at 30, 32, 34 and 36.

The hull structure of the aircraft preferably comprises a composite material consisting of a rigid foam or honeycomb core of radar-transparent polymer, having a facing on both sides of Kevlar, epoxy-embedded glass fiber matrix, or a similar radar-transparent material. Supporting ribs and spars in the interior of the hull are also preferably formed from radar-transparent materials. An example of a suitable material for the internal ribs and spars is a glass-fiber reinforced epoxy resin. Such a resin can be formed into the desired spar or rib shape by a pultrusion process. Of course, parts of the aircraft hull and internal structure which do not affect performance of the internal antennas can be made of any desired material.

Figure 4:
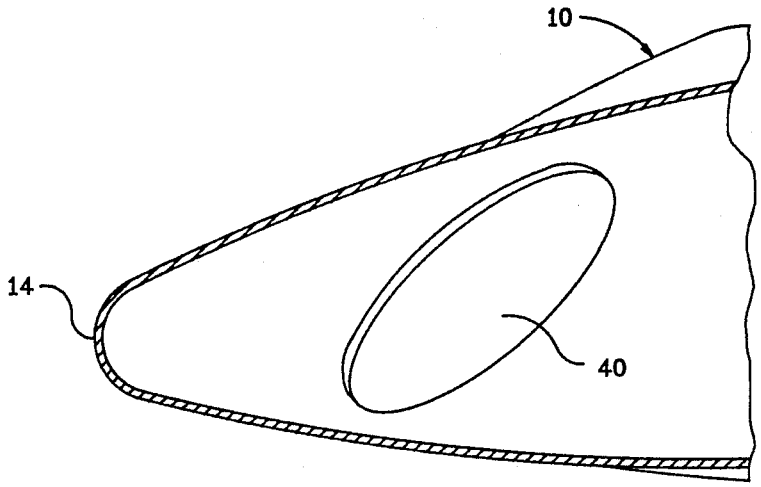
FIG. 4 is a diagrammatic vertical section taken on plane 4—4 of FIG. 1.

As shown in FIG. 1, located within the aircraft hull are three planar antenna arrays 38, 40 and 42. These three arrays are circular in shape, and identical to one another. Antenna array 40, as shown in FIG. 4, is tilted at a 45 degree angle relative to the horizontal, so that array 40 faces upwardly and outwardly through leading edge 14. Array 38 is situated at a similar angle inside the opposite leading edge 12. Similarly, array 42 faces upwardly at a 45 degree angle through the upper surface of the hull, between propulsion units 32 and 34.

Tilting the planar antenna arrays so that, for example, they face upwardly at approximately 45 degree angles has three important effects. First, it enables the antenna arrays to scan from the zenith to below the horizon. Secondly, it enables the arrays, although of large dimensions, to fit inside the limited vertical space within the aircraft hull near the leading edges, and near the trailing edge. Third, tilting the arrays reduces the required overall hull dimensions. A system of antenna arrays of the same size, if arranged in vertical planes, would require a vastly larger hull.

The three planar antenna arrays 38, 40 and 42 are situated in planes such that horizontal diameters of the circular arrays, if extended, would form an equilateral triangle. As a planar phased array can be electronically steered through a horizontal angle of approximately 120 degrees, situating the antenna arrays so that their diameters form parts of an equilateral triangle, make 360 degree azimuthal scanning coverage possible with only minimal beam degradation at the points of overlap.

The three planar antenna arrays need not be circular as in FIGS. 1–4. FIGS. 5 and 6 show, for example, a surveillance platform 43, similar to that in FIGS. 1–4, except that the three antenna arrays 44, 46 and 48 are in the form of elongated rectangles, each situated at a 45 degree angle relative to the horizontal, and have their long dimensions along the faces of an equilateral triangle.

In the alternative embodiment of FIG. 7, airborne surveillance platform 49 has, inside its port side leading edge, an upper planar antenna array 50 facing upwardly at a 45 degree angle, and a lower antenna array 52 facing downwardly at a 45 degree angle. Similar pairs of antenna arrays are provided inside the opposite leading edge, and inside the trailing edge. The antenna configuration of FIG. 7 is capable of scanning through a full 360 degrees of azimuth, and from the zenith to the nadir. Thus, it is omnidirectional. The configuration of FIG. 7 has particular utility in the detection and tracking of cruise missiles and other low flying missiles.

Figure 8:
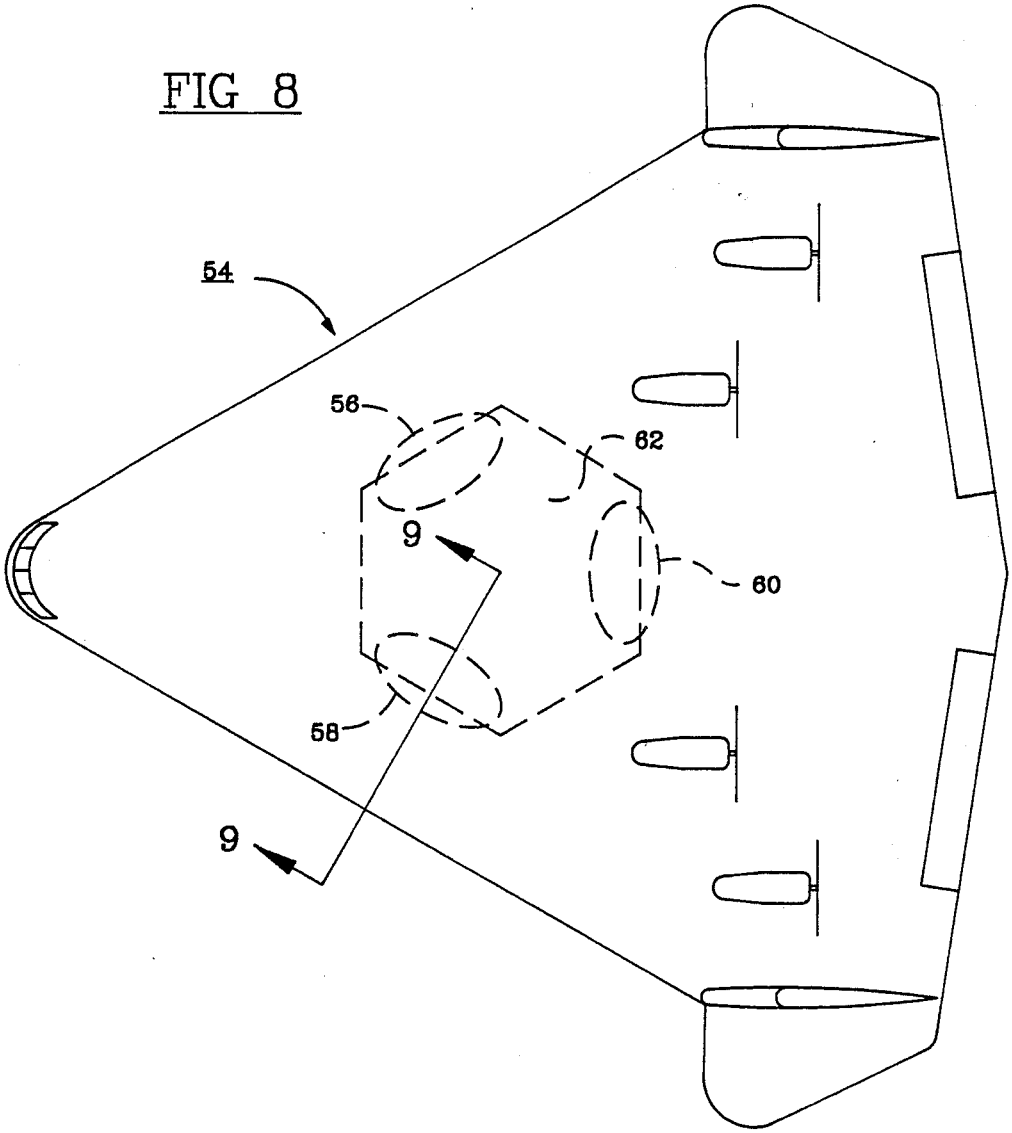
FIG. 8 is a top plan view showing a further alternative configuration of planar phased arrays.
Figure 9:
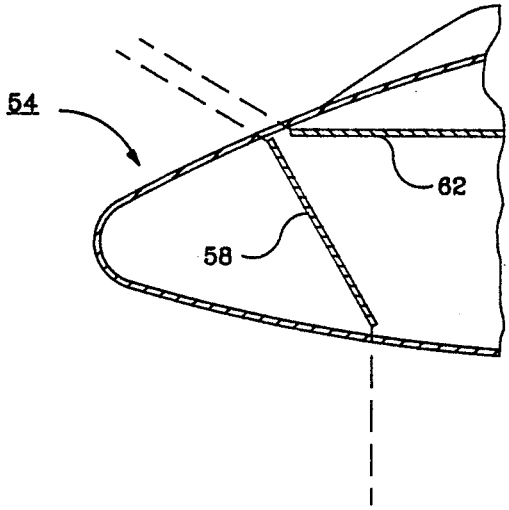
FIG. 9 is a diagrammatic sectional view taken on the plane 9—9 of FIG. 8.

An alternative way of achieving substantially omnidirectional scanning is shown in FIGS. 8 and 9, in which airborne surveillance platform 54 has four internal planar phased arrays. Three of the internal arrays, 56, 58 and 60 are circular, and arranged so that their horizontal diameters form parts of the sides of an equilateral triangle. As shown in FIG. 9, planar array 58 is situated an an angle of 60 degrees relative to the horizontal, so that it faces downwardly at an angle of 30 degrees from the horizontal. This enables it to scan from 30 degrees above the horizon to 180 degrees below the horizon, or directly downwardly. Each of the other circular planar phased arrays 56 and 60 is similarly situated for scanning through a vertical range from 30 degrees above the horizon to 180 degrees below. The fourth planar phased array is a hexagonal array 62, which is situated horizontally within the platform hull near the upper ends of planar arrays 56, 58 and 60. Horizontal array 62 can be electronically steered in all azimuthal directions and in elevation from 30 degrees above the horizontal to 90 degrees, or directly upwardly. Thus, the four planar arrays of FIGS. 8 and 9 can act together to provide substantially omnidirectional scanning.

The designer has a wide variety of choices so far as the tilt angle of planar arrays is concerned. For example, if the direction of primary interest is in the vicinity of the horizon or slightly below the horizon, and the direction directly below the platform is not important, three planar arrays can be arranged at angles 70 degrees above the horizon (i.e. at a declination of 20 degrees). This will optimize performance of the antenna in directions 20 degrees below the horizon, and allow scanning from about 40 degrees above the horizon to 80 degrees below the horizon.

Figure 10:
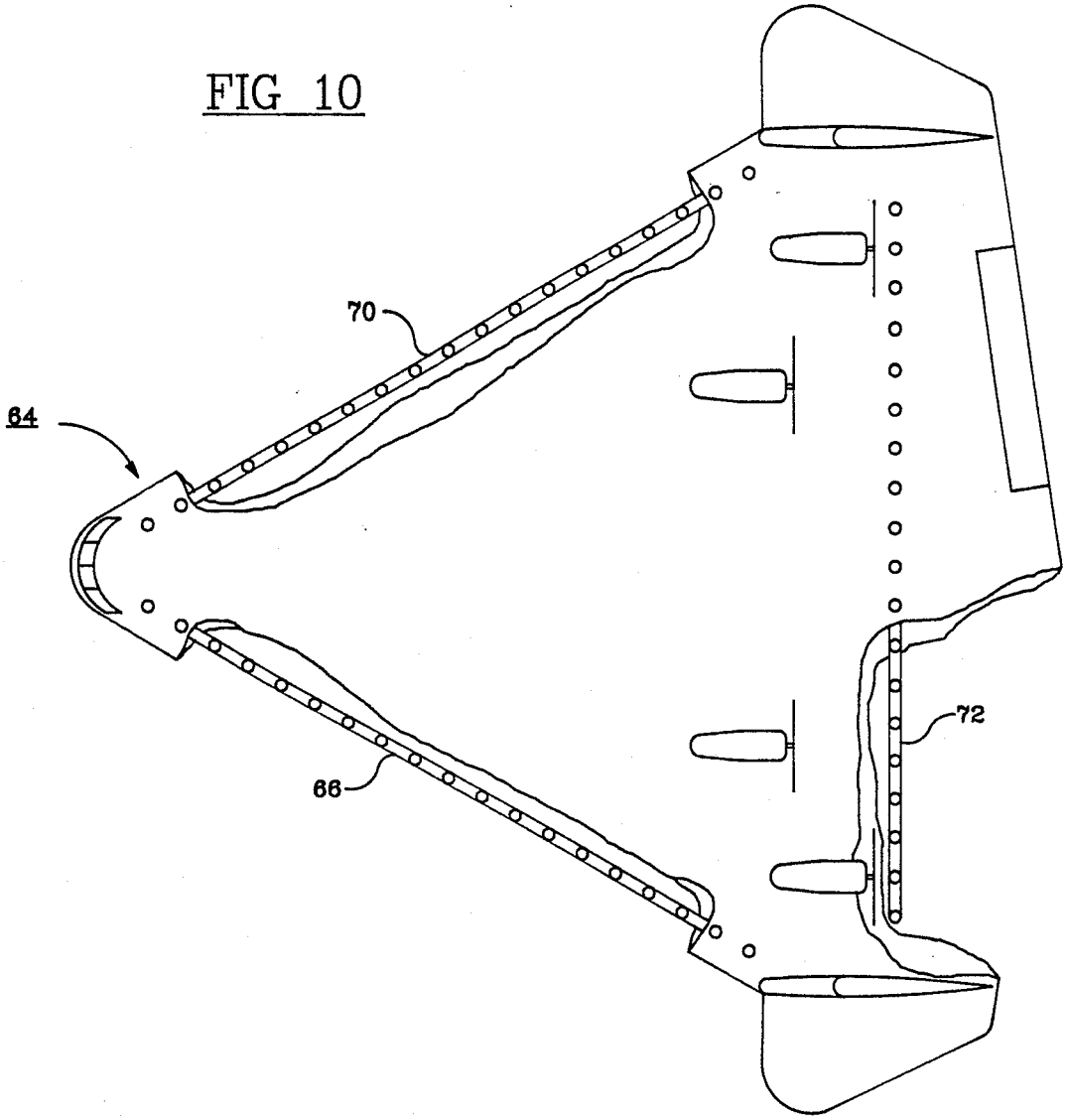
FIG. 10 is a partially broken away diagrammatic plan view of an airborne surveillance platform in accordance with the invention, utilizing linear phased arrays.
Figure 11:
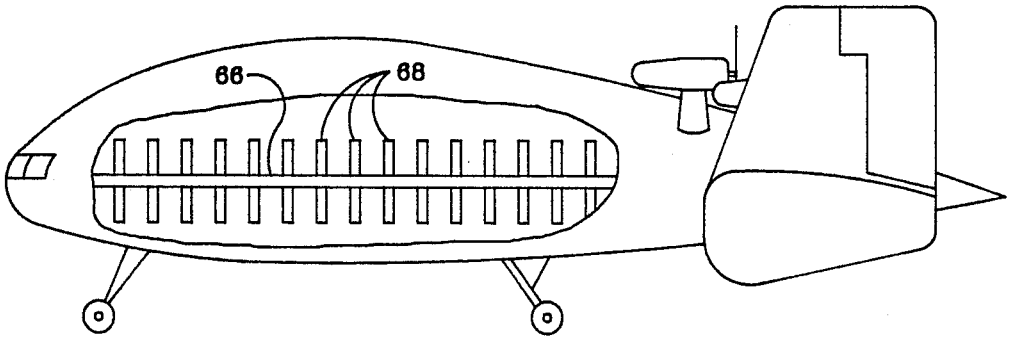
FIG. 11 is a partially broken away side elevation of the platform of FIG. 10.

FIGS. 10 and 11 show an airborne surveillance platform which utilizes three linear phased arrays for scanning in all azimuthal directions. Platform 64 is a delta-shaped aircraft similar to the aircraft of FIGS. 1–9. Inside its port side leading edge, there is provided a linear phased antenna array 66, which comprises a series of dipoles 68 interconnected with the radar transmitting and/or receiving apparatus in such a way that the main antenna lobe can be steered electronically through a wide horizontal range. A similar linear array 70 is provided inside the starboard side leading edge, and still another similar linear array 72 is provided inside the trailing edge. The three linear arrays, acting together, provide for electroncially controlled scanning throughout a full 360 degree azimuthal range. The shape of the aircraft hull is such that the vertical space within the interior of the hull near the leading and trailing edges allows adequate room for the height of the vertically elongated dipole elements. If greater height is needed, the linear arrays can be positioned more toward the interior of the hull. If the antenna arrays are moved toward the interior of the hull, they must also be lengthened.

The surveillance platform in accordance with the invention carries antennas, having very large areas, internally, and in a configuration which allows the antennas to scan through a full 360 degrees in a continuous pattern in all azimuthal directions. The large area of the antennas, made possible by the aircraft configuration, makes it possible to achieve highly directional electronically controlled scanning at microwave frequencies. The large dimensions of the platform also make it possible to utilize long wavelength radar antennas, which can be more effective than short wavelength radar in some situations.

The deltoid platform configuration and the triangular antenna array allow the cockpit, engines and fins to be located out of the main path of radiated microwave energy. This reduces the chance of injury to the crew and interference with radar performance by the metallic parts of the engines and fins. Blind spots will result for close distances. However, the beams of adjacent arrays can be made to converge, thereby eliminating blind spots at greater distances.

While the preferred embodiments of the invention, shown in FIGS. 1–11, utilize three, four or six planar antenna arrays, or three linear arrays, it is possible to realize many of the advantages of the invention with other radar antenna arrays such as, for example, ring-shaped radar antennas. A typical ring-shaped radar antenna is thirty feet high and fifty feet in diameter. It cannot be accommodated inside a conventional aircraft, but can be easily accommodated inside a triangular aircraft as herein described, if approximately centered at the location of the maximum vertical dimension of the aircraft hull. The invention is applicable both to radar surveillance in which an outgoing signal is generated and its reflector received and analyzed, and to passive surveillance, in which signals generated in a target are received and analyzed.

The angle formed by the two leading edges of the aircraft hull is preferably close to 60 degrees, resulting in an aspect ratio in the range of approximately 1.7 to 2.3, depending primarily on the shape of the trailing edge structure. This angle, however, can be modified considerably to achieve desired flight performance and other aircraft characteristics without impairing the performance of the internal antenna arrays. Preferably, the aircraft hull is designed with an aspect ratio of 2.0 or less.

Still further alternative antenna configurations can be used, and other modifications made to the aircraft hull, without departing from the scope of the invention as defined in the following claims.

I claim:

1. An airborne surveillance platform comprising a radar-transparent hollow airfoil enclosing an interior space, said airfoil having a delta-shaped planform with a narrow nose at one corner, leading edges extending from the nose to the opposite corners, and a trailing edge extending betweeen said opposite corners, the planform being substantially symmetrical about a plane of symmetry extending from said narrow nose to the midpoint of the trailing edge, ellipse-like cross-sections transverse to said plane through substantially all of the length of the airfoil, a maximum height dimension in said plane perpendicular to the chord in said plane at a location spaced from said trailing edge and from said nose, said ellipse-like cross-sections progressively decreasing in height, measured in said plane, throughout substantially the entire distance from the cross-section at the point of maximum height toward said trailing edge, and a phased array antenna physically stationary relative to the airfoil, said antenna being arranged to scan horizontally, while the airfoil is in level flight, in a substantially continuous pattern in all azimuthal directions and being fixed in a position substantially entirely within said interior space so that substantially all radiant energy received by said antenna passes through said airfoil.

2. An airborne surveillance platform according to claim 1 in which the antenna is also arranged to scan throughout a vertical range in a substantially continuous pattern in all azimuthal directions.

3. An airborne surveillance platform according to claim 1 in which the antenna is also arranged to scan substantially from below the horizon to the zenith in a substantially continuous pattern in all azimuthal directions.

4. An airborne surveillance platform according to claim 1 in which the antenna is also arranged to scan substantially from the nadir to the zenith in a substantially continuous pattern in all azimuthal directions.

5. An airborne surveillance platform according to claim 1 in which the antenna comprises a first planar antenna array arranged to scan through one of said leading edges, a second planar antenna array arranged to scan through the other of said leading edges, and a third planar antenna array arranged to scan through said trailing edge.

6. An airborne surveillance platform according to claim 5 in which the planes of the planar antenna arrays are situated at angles of approximately 45 degrees relative to the horizon when the aircraft hull is in level flight, whereby the antenna is capable of scanning from below the horizon to the zenith in a substantially continuous pattern in all azimuthal directions.

7. An airborne surveillance platform according to claim 1 in which the antenna comprises first, second, and third planar antenna arrays arranged respectively to scan through the two leading edges and said trailing edge substantially from the horizon to the zenith in a substantially continuous pattern, and fourth, fifth and sixth planar antenna arrays arranged respectively to scan through the two leading edges and said trailing edge substantially from the horizon to the nadir in a substantially continuous pattern.

8. An airborne surveillance platform according to claim 1 in which the antenna comprises first, second and third planar antenna arrays arranged respectively to scan through the two leading edges and said trailing edge in a substantially continuous pattern from above the horizon to below the horizon, and a fourth planar antenna array arranged to scan in a continuous pattern in all azimuthal directions from the zenith to the uppermost scanning directions of the first, second and third antenna arrays.

9. An airborne surveillance platform according to claim 8 in which, when the airfoil is in level flight, the plane of each of the first, second and third planar antenna arrays is situated at an angle of approximately 60 degrees relative to the horizontal and the fourth planar antenna array is horizontal.

10. An airborne surveillance platform according to claim 1 in which the antenna comprises a first linear phased array located inside and extending along one of the leading edges, a second linear phased array extending along and located inside the other of the leading edges, and a third linear phased array extending along and located inside the trailing edge.

11. An airborne surveillance platform comprising a radar-transparent aircraft hull having a delta-shaped planform with a narrow nose at one corner, leading edges extending from the nose to the opposite corners, and a trailing edge extending between said opposite corners, the planform being substantially symmetrical about a plane of symmetry extending from said narrow nose to the midpoint of the trailing edge, ellipse-like cross-sections transverse to said plane through substantially all of the length of the hull, a maximum height dimension in said plane perpendicular to the chord in said plane at a location spaced from said trailing edge and from said nose, said ellipse-like crosssections progressively decreasing in height, measured in said plane, throughout substantially the entire distance from the cross-section at the point of maximum height toward said trailing edge, and a phased array antenna physically stationary relative to the hull, said antenna being arranged to scan horizontally, while the aircraft is in level flight, in a substantially continuous pattern in all azimuthal directions and being fixed in a position substantially entirely within the interior of said hull so that substantially all radiant energy received by said antenna passes through said hull.

* * * * *

UNITED STATES PATENT AND TRADEMARK OFFICE

CERTIFICATE OF CORRECTION

PATENT NO. : 4,896,160

DATED : January 23, 1990

INVENTOR(S) : Wm. McE. Miller, Jr.

It is certified that error appears in the above-identified patent and that said Letters Patent is hereby corrected as shown below:

On the title page, line 4, delete "Assignee: Aereon Corporation, Princeton, N.J."

Signed and Sealed this

Twenty-fifth Day of February, 1992

*Attest:*

HARRY F. MANBECK, JR.

*Attesting Officer*

*Commissioner of Patents and Trademarks*